US005085115A

United States Patent [19]

Schlink

[11] Patent Number: 5,085,115

[45] Date of Patent: Feb. 4, 1992

[54] ELECTRIC GUITAR/VIOLIN

[76] Inventor: Robert Schlink, 78 Priscilla Ave., Providence, R.I. 02909

[21] Appl. No.: 578,075

[22] Filed: Sep. 5, 1990

[51] Int. Cl.[5] ..... G10H 3/00; G10D 3/06

[52] U.S. Cl. ..... 84/310; 84/314 R; 84/726

[58] Field of Search ..... 84/726, 310, 743, 314 R

[56] References Cited

U.S. PATENT DOCUMENTS

| | | | |
|---|---|---|---|
| 4,311,078 | 1/1982 | Falgares | 84/314 R |
| 4,915,009 | 4/1990 | Kunstadt | 84/726 |
| 4,919,033 | 4/1990 | Markov et al. | 84/726 |

*Primary Examiner*—William M. Shoop, Jr.
*Assistant Examiner*—Helen Kim

[57] ABSTRACT

A musical instrument having at least six strings tuned and fingered like an electric guitar, and having a symmetrically arched fingerboard (12 or 13), nut (31) and bridge (15 or 16) configuration to allow each string to be played individually with a violin bow. In addition, a transducer (26 or 29) is mounted at the bridge to pick up the bowed sound and the arched double coil pick-up (14) is mounted underneath the strings to pick up the plucked sound of the string. An adjustable support mechanism (20) allows the instrument to be held so that the bow passes over the shoulder or clavicle. The bridge position relative to the player's body allows a scale length equal to that of the guitar to be practical. The fact that this instrument is played with a bow allows the fingerboard to be extended to 40 frets or the equivalent.

17 Claims, 12 Drawing Sheets

ELECTRIC GUITAR/VIOLIN

BACKGROUND

1. Field of Invention

This invention relates to the field of stringed musical instruments, specifically to electric guitars and electric violins, the said invention having characteristics of both.

2. Description of Prior Art

Electric guitars are commonly used by string instrumentalists, as are electric violins.

Sound is produced by plucking or tapping the strings on an electric guitar, and by plucking or drawing a bow across the strings on an electric violin.

Attempts were made by some guitarists to use a bow drawn across the strings on a standard electric guitar, but this technique is severely limited. The strings of an electric guitar are fixed on a relatively flat plane with regards to each other. This positioning of the strings does not allow a bow discreet access to the inner strings. Only the lowest, the highest, or all of the strings at once can be played with a bow using the standard electric guitar string/bridge configuration.

The electric violin has a much more pronounced curve or arch in the bridge, string configuration and fingerboard, which allows access by the bow to all individual strings. However, electric violins have no frets, a much smaller scale (length of string from bridge to nut) than guitars, four (4) strings, and are tuned in 5ths, making the standard guitar fingerings inapplicable, and making it impossible for a guitarist to transfer his knowledge of guitar fingerings directly to the violin.

The present forms of the electric violin and viola were derived from their acoustic counterparts. Three factors historically limited the maximum scale length possible on a bowed instrument supported with the shoulder and played with the bow passing over the player's shoulder or clavicle. One factor is the length of the average player's arm. The arm used for fingering must be able to reach the nut easily. The second factor is the position of the bridge. The bridge of an acoustic instrument must be mounted more or less in the center of a vibrating sound board. This results in the bridge being positioned approximately in line with the player's shoulder joint on a violin or viola. The final factor is the body size required to produce low notes on an acoustic instrument. The body size required to adequately produce the low E of the guitar would be too large to be played in the violin position. The bridge position mentioned above, as well as the body size factor, were rendered unnecessary by the development of the electric violin and viola. However, the traditional structure, scale and playing position were retained because the players were trained to play this way.

The instrument of the present invention combines an adaptation of the standard guitar position with an adaptation of the standard violin position by means of a special supporting device. In this way, the body of the instrument is brought up higher on the player's body than the guitar position, and lower off of the player's shoulder than the standard violin position. The top surface of the fingerboard is tilted down and forward from the horizontal plane so as to more closely simulate the fingering position of the guitar and to allow the bow to pass over the player's shoulder. The resulting positioning of the bridge in front of and slightly below the player's chin, rather than above the shoulder joint, allows the scale to be increased to that of the guitar (approx. 24 to 25 inches).

U.S. Pat. Nos. 1,297,585 (A. T. Newman, 1919) and 1,635,429 (H. Miller, 1925) show a violin/banjo and a violin/mandolin respectively. These instruments are strictly acoustic and have as their objects an alerting or improvement of the sound or timbre of the violin. Neither of these instruments offer significant advantages to players from a different group of stringed instrumentalists (such as guitarists) as both the tenor banjo and the mandolin are tuned and fingered in the same way as the violin anyway.

U.S. Pat. No. 4,311,078 (F. Falgares, 1982) shows an electric guitar which has an arched fingerboard and may be played with a bow. Falgares instrument is intended to be played in the standard guitar playing position. Towards this end, a wedge is provided (section C of claim 1) to raise the fingerboard, nut and bridge on the bass side. However, this playing position is inherently undesirable, as the player's fingering hand must also stabilize the instrument, thus severely limiting playing technique. In light of this fact, the electric guitar/violin of the present invention, because of its minimal mass and special support mechanism, is intended to be played with the bow passing over the player's clavicle or shoulder, which is the universally preferred position for instruments small enough to be played this way. Hence, the wedge raising the bass side of the fingerboard, nut and bridge mentioned in section C of claim 1 of Falgares patent is extraneous and is not used in the present invention. Also, Falgares instrument shows a standard pick-up configuration which does not allow the range possible with the 40 fret fingerboard of the present invention. Although the 40 fret fingerboard length is of questionable value on a standard guitar because of the sound made by plucking a string of such short length, the method of playing the present invention with a bow makes this range musically valid and extends the range of this instrument beyond the practical limits of the violin.

OBJECTS AND ADVANTAGES

Accordingly, several objects and advantages of the present invention are:

(a) to allow an increased scale length on an instrument played with a bow passing over the player's shoulder.

(b) to allow guitarists access to actual bowed string sounds.

(c) to allow guitarists to access said sounds using only his or her knowledge of guitar fingerings and positions without the necessity of learning any new fingerings;

(d) to allow a pizzacatto or plucked sound as close to an electric guitar as possible;

(d) to allow the guitarist the choice of the increased accuracy of frets or the warmer sound and greater flexibility of a fretless instrument;

(f) to produce an instrument of at least six strings, tuned and fingered like a guitar, and capable of being played with a bow, and a size and weight allowing it to be played with the bow passing over the shoulder;

(g) to maintain a fingering position as close to that of the guitar as possible;

(h) to produce an instrument, played with a bow, capable of a greater range than the violin, viola, or cello alone.

Further objects and advantages will become apparent from a consideration of the ensuring description and drawings.

DRAWING FIGURES

In the drawings, closely related figures have the same number but different alphabetic suffixes.

REFERENCE NUMERALS IN DRAWINGS

Figure 1A:
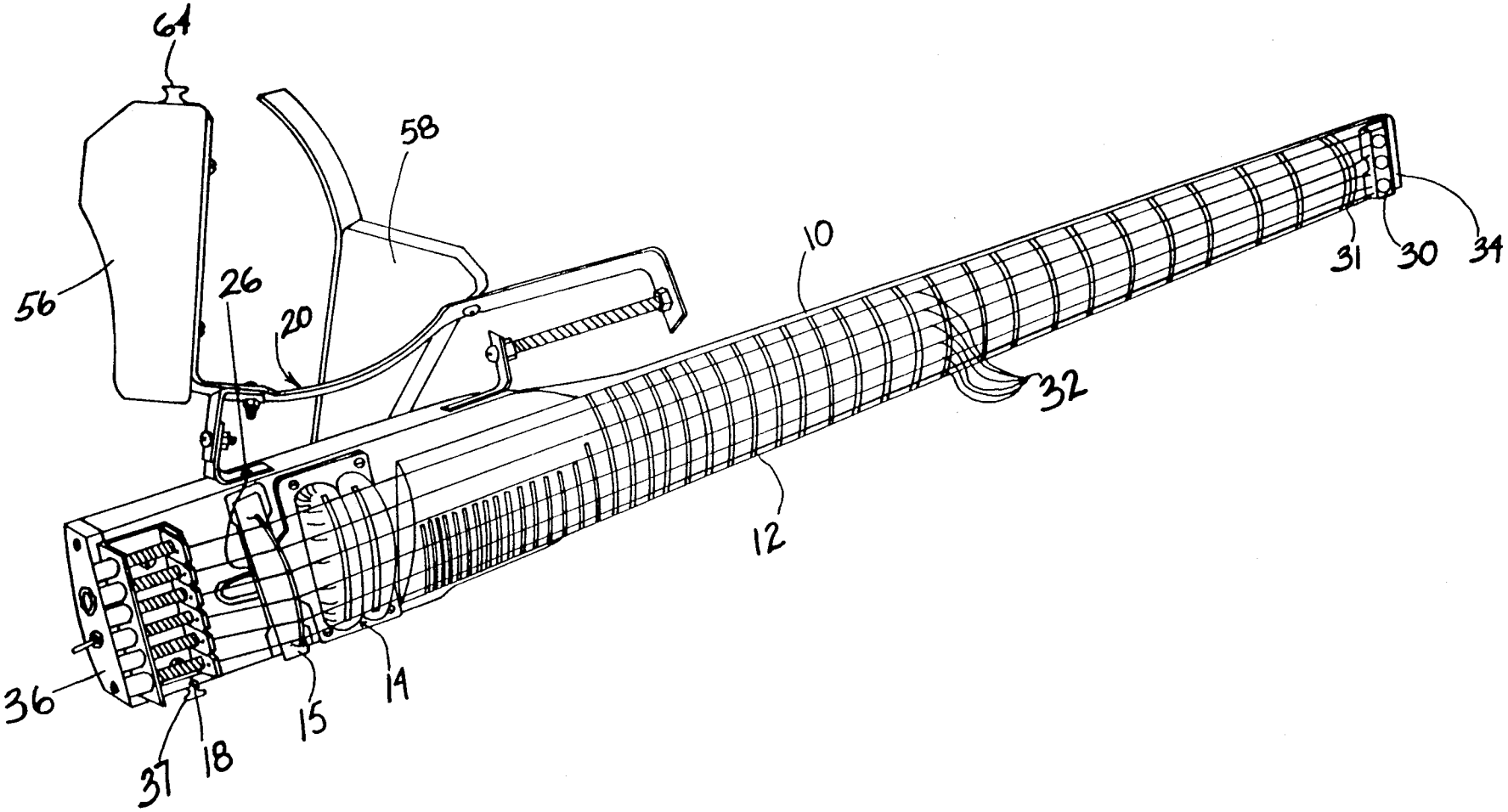
FIGS. 1A and 1B show perspective views of two typical embodiments of this invention (fretted and fretless respectively) including the support mechanism.

10 one-piece body/neck member
11 frets
12 40 fret arched fingerboard
13 fretless arched fingerboard
14 arched double coil pick-up
15 arched layered bridge
16 arched solid bridge
18 tuning mechanism
20 support mechanism
22 truss-rod
23 cavity routed in body for double coil pick-up
24 top wood layer of layered bridge
25 rubber sound absorbing layer of layered bridge
26 transducer (wafer type)
27 wood pedestal layer of layered bridge
28 mortise for transducer
29 transducer (bar type)
30 string lock
31 nut
32 string (1 shown, six actual)
34 neck end cap
36 body end cap
37 strap pin
38 coils of pick-ups
39 bolt
40 blades of pick-ups
41 nut
42 magnet of pick-up
44 tie wire
46 allenhead screw
48 upper angle bracket
50 lower angle bracket
52 brass string retainers
53 mounting screw
54 bracket
56 chin block
58 support foot
60 angle bracket
62 retaining screw
63 retaining screw
64 strap end pin

DESCRIPTION—FIGS. 1 TO 8

Figure 1B:
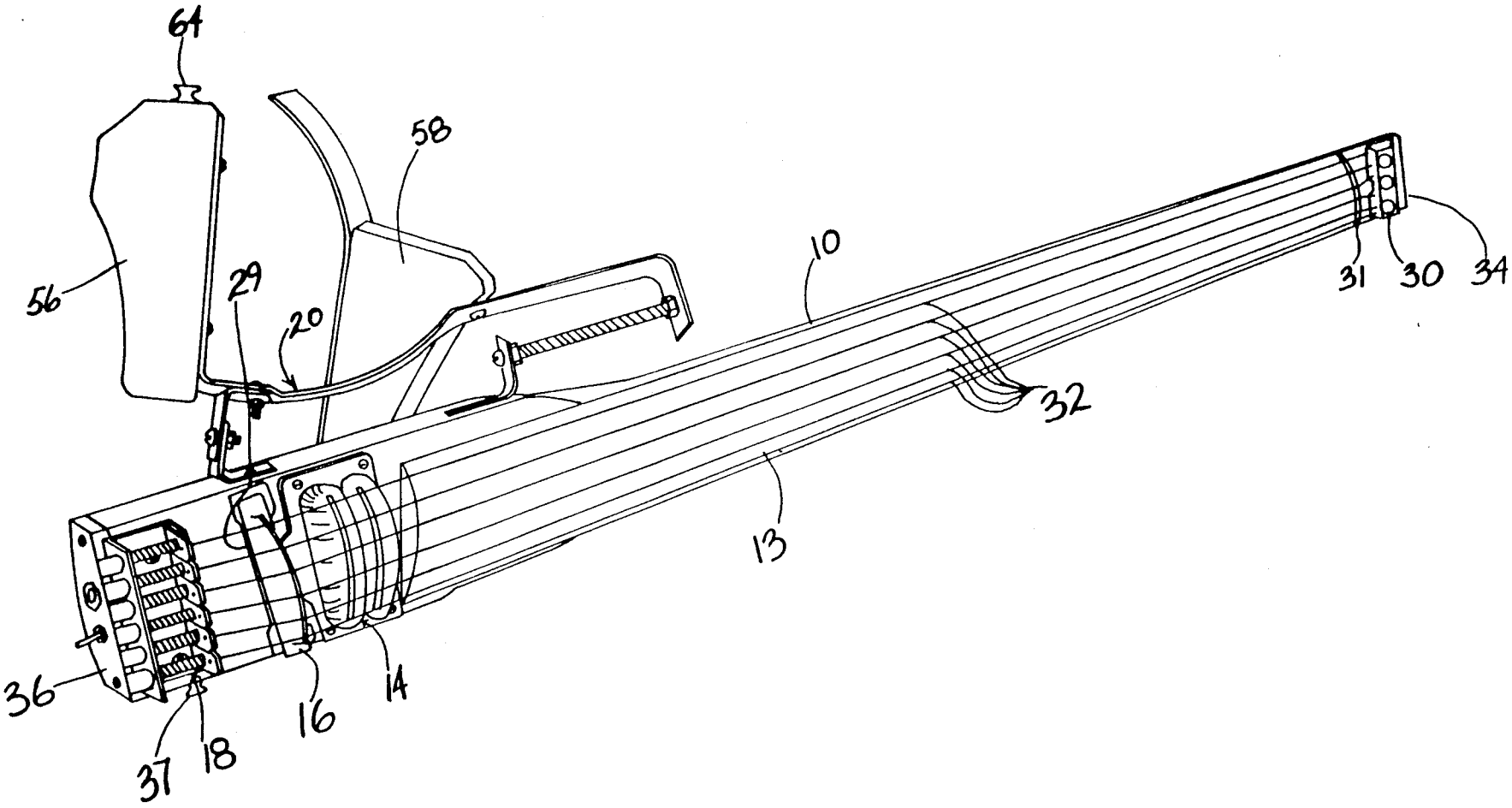
Figure 2A:
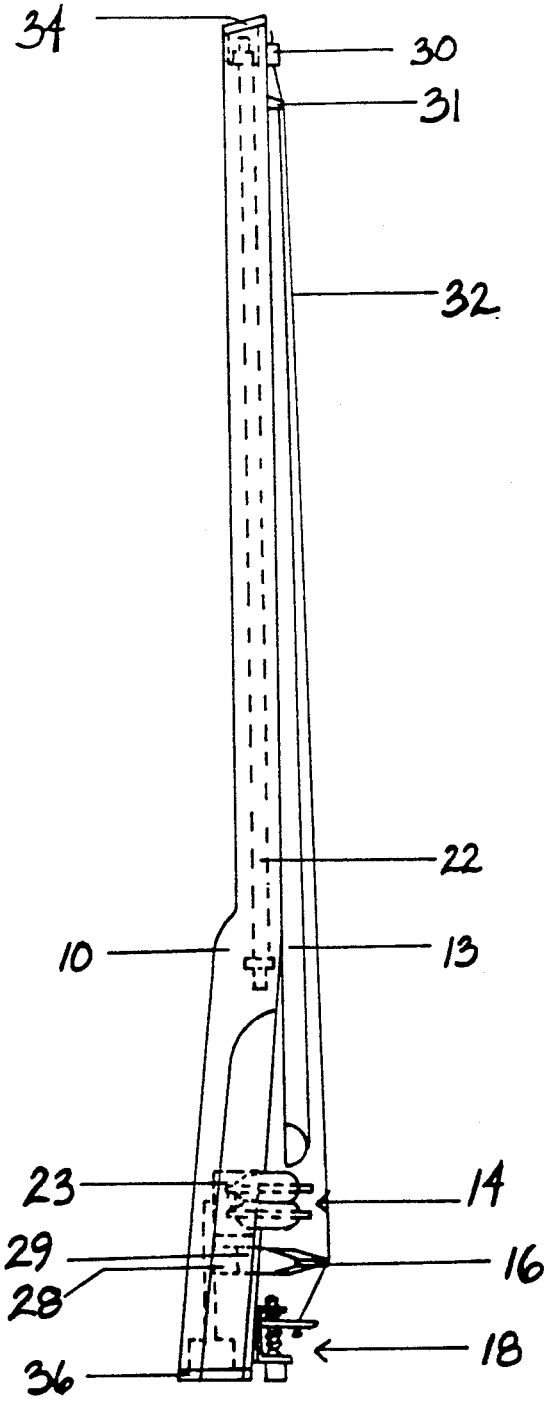
FIG. 2A shows a side view of said invention without the support mechanism.
Figure 2B:
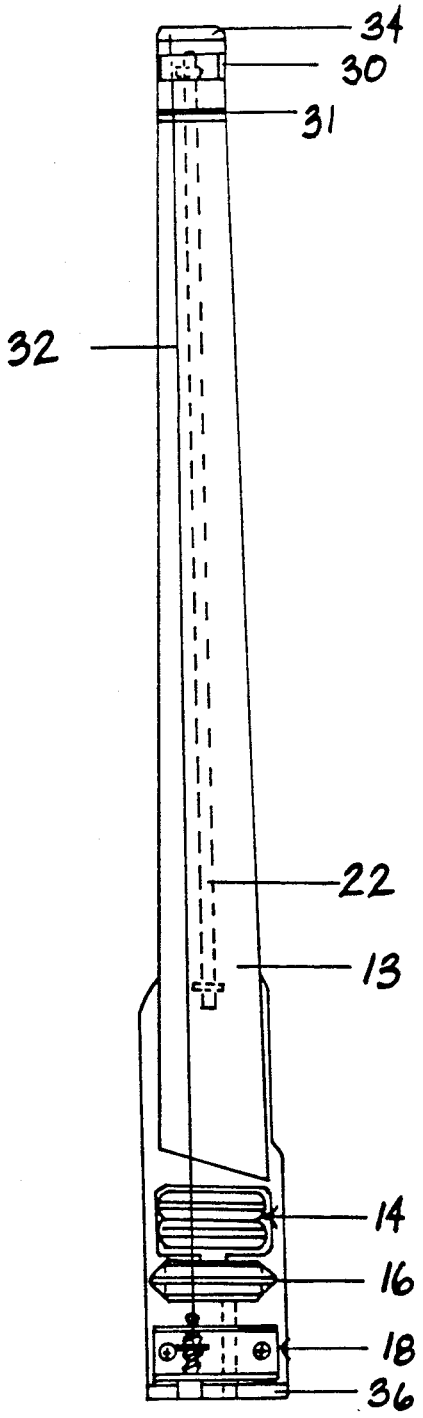
FIG. 2B shows a top view of said invention without the support mechanism.
Figure 3:
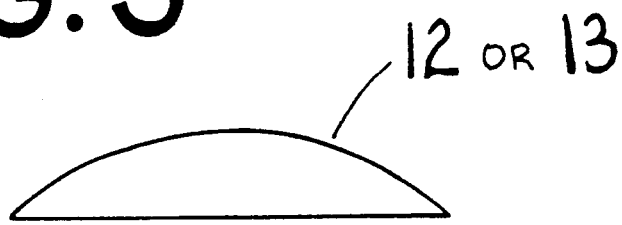
FIG. 3 shows a cross-sectional view of the arch of the lower end of the fingerboard.
Figure 4:
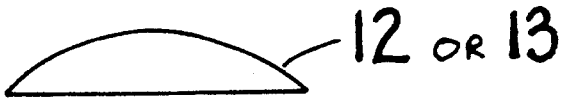
FIG. 4 shows a cross-sectional view of the arch of the upper end of the fingerboard.
Figure 5A:
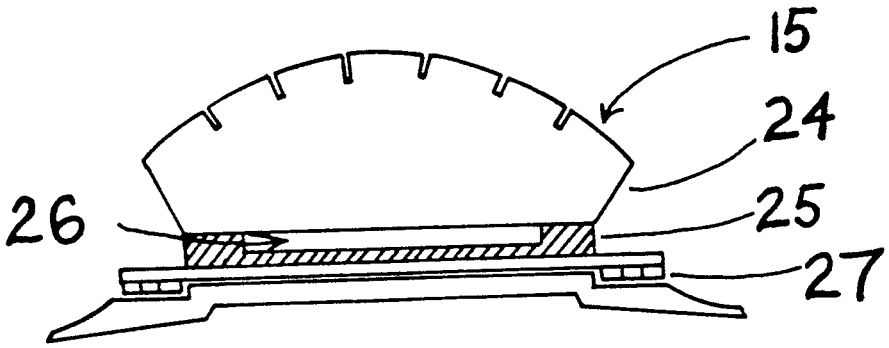
FIG. 5A shows a view of a layered bridge and mounting provision for a wafer style transducer.

Typical embodiments of the stringed instrument of the present invention are illustrated in FIG. 1A (perspective view 40 fret model), FIG. 1B (perspective view fretless model), FIG. 2A (side view), and FIG. 2B (top view). The instrument has a one-piece neck/body member (10) with a symmetrically arched 40 fret fingerboard(12) or fretless fingerboard (13), and arched nut (31) laminated to the top face of the neck. In the preferred embodiment, the one-piece neck/body member (10) is constructed of solid stable hard wood (characterized by mahogany) and is reinforced by a ¼ inch steel truss-rod (22) see FIG. 5. In this embodiment, the fingerboards (12 and 13) are constructed of a stable solid hardwood (characterized by walnut or koa). However, the neck/body member can be constructed of any suitable rigid material, solid or hollow, such as molded plastic, aluminum, steel, or various other metals or resin materials, etc. If the material selected or the structure (such as a "honey-comb" molded neck bed) are of sufficient rigidity, the truss-rod (22) may be eliminated. Likewise, the arched fingerboards (12 and 13) may be constructed with any of the above materials or techniques or may be included in the casting or molding of the neck/body member.

In these embodiments the arched double coil pick-up (14) is mounted between the end of the fingerboard (12 or 13) and the bridge (15 or 16). A cavity (23) is routed into the body to accept the pick-up (14) (shown in FIGS. 2A and 2B).

Figure 5B:
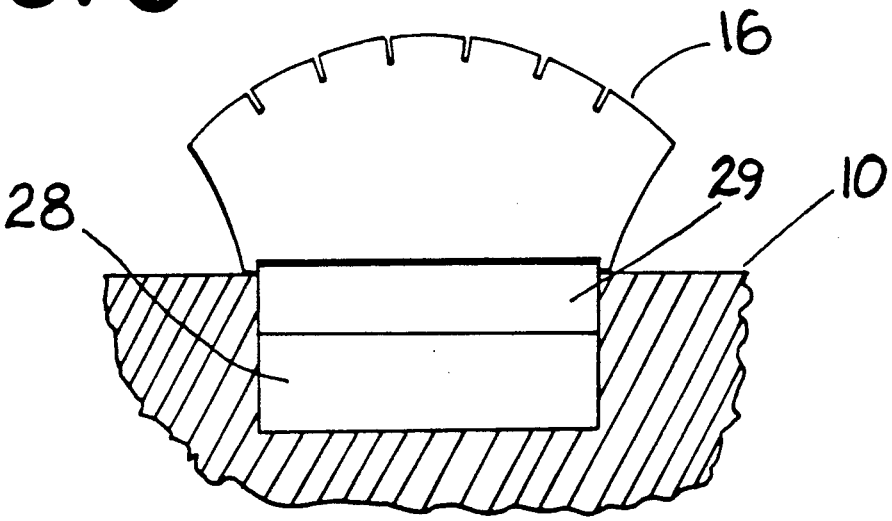
FIG. 5B shows a view of the bridge and shows a detail of the mortise for the transducer.

A commercially available contact type transducer (26) is mounted in a space under the top layer (24) of the layered bridge. This transducer (26) receives vibrations from the top layer (24) which contacts and supports the strings (32). This top layer (24) and the transducer (26) are insulated acoustically from the pedestal layer (27) by a layer of sound absorbing material (25) characterized by rubber. This system eliminates phase cancellation caused by string vibrations reaching the transducer (26) through the neck/body member (10), (See FIG. 5A). An alternate method of transducer mounting is shown in FIG. 5B which uses a commercially available bar type transducer (29) mounted in a mortise underneath and contacting a solid bridge (16).

Figure 6:
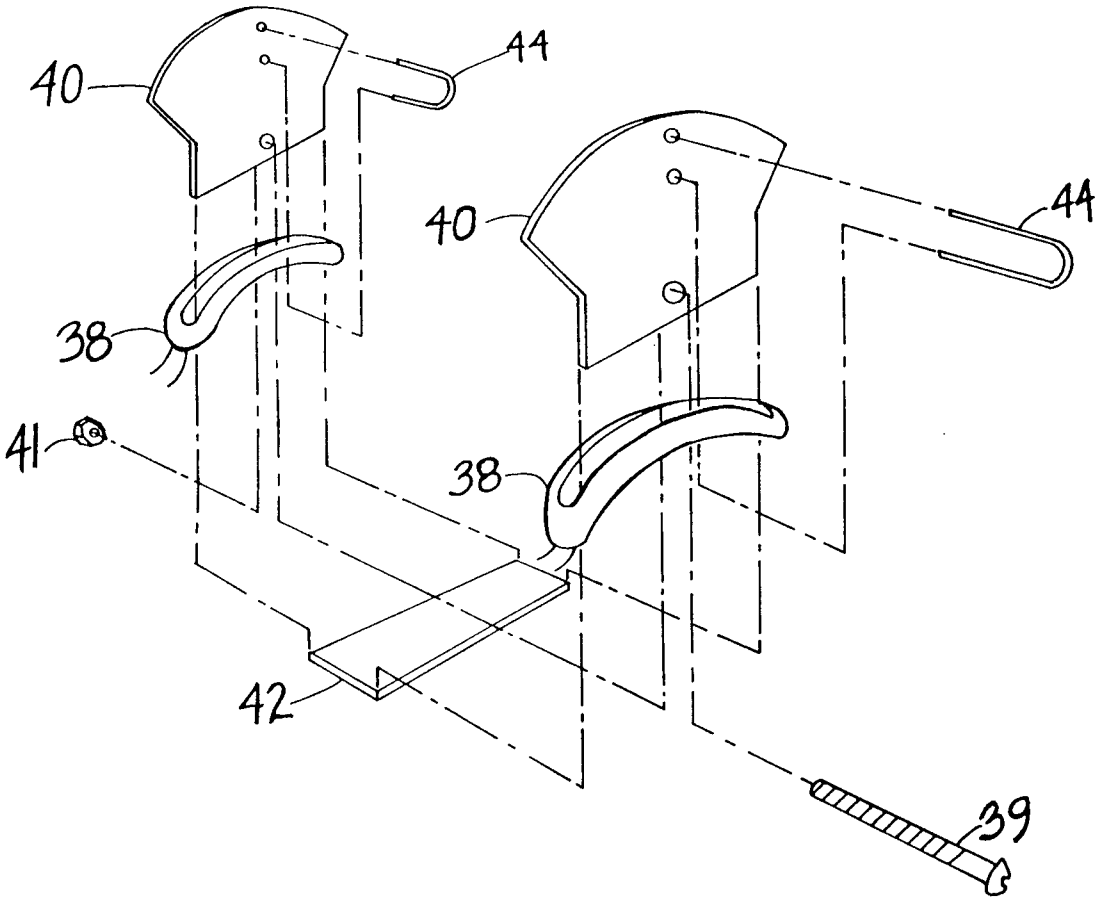
FIG. 6 shows an exploded view of the specially arched double-coil pick-up.
Figure 7A:
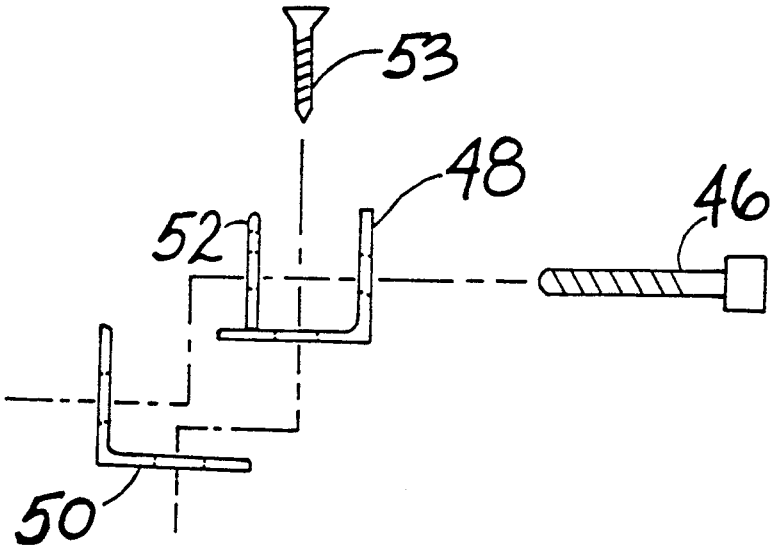
FIGS. 7A, 7B, 7C show an exploded view of details of the tuning mechanism.
Figure 7B:
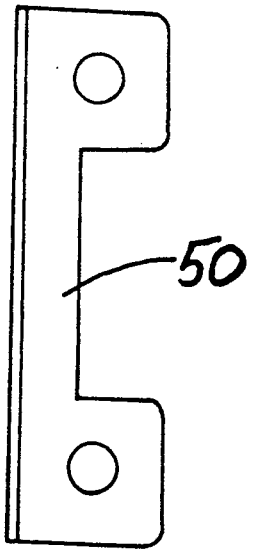
Figure 7C:
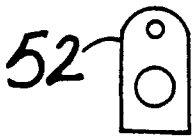

The arched double coil pick-up (14) is constructed of two coil members (38) in this embodiment they are constructed with approx. 3600 turns of #42 magnet wire wrapped on a flexible form (characterized by electrical tape). These coil members (38) are affixed to the steel core blades (40) by a tie wire (44) so as to conform to the arch of the top of the blades (40). Below the coils and touching the bottom edge of each blade (40) is a permanent magnet (42) (see FIG. 6). This method can be used to manufacture single coil pick-ups also.

The tuning mechanism (18) shown in FIG. 1 and FIGS 7A, 7B, and 7C consists of six screws with allen heads (46) and a lower angle bracket (50) via six holes drilled in each bracket. Each of these six screws also passes through a brass string retainer (52) by means of a threaded hole. A smaller hole is drilled at the top of each brass string retainer to allow the guitar string (32) to pass through it. The strings are fixed at the other end of the neck by means of a commercially available string lock mechanism (31). The tension of the six strings can then be varied by tightening or loosening the allen head screws (46) with a hex key wrench.

An important distinguishing structural feature over the prior art is the support mechanism (20), (FIG. 1 and FIGS. 8A, 8B and 8C) which comprises a curved metal bracket (54) which has a wooden chin block (56) attached to one end, a support foot (58) attached in the center, and is attached to the instrument by means of two angle brackets (60,61) and retaining screws (62,63). A strap end pin (64) is present on the chin block and on the opposite side of the instrument to accommodate a standard neck strap. This entire support mechanism is attached to the instrument so as to position the body member parallel to and in front of the player's clavicle, with the bridge in front of and slightly below the player's chin. The top surface of the instrument is tilted downward and forward by means of the retaining screws (62,63) when the instrument is being played. This overcomes the scale limiting factor found in conventional violin and viola construction wherein the bridge is mounted over and approximately aligned with the player's shoulder joint. Many other methods of construction are possible for this support means, with this positioning of the bridge relative to the player's body as the main distinguishing factor.

Figure 8A:
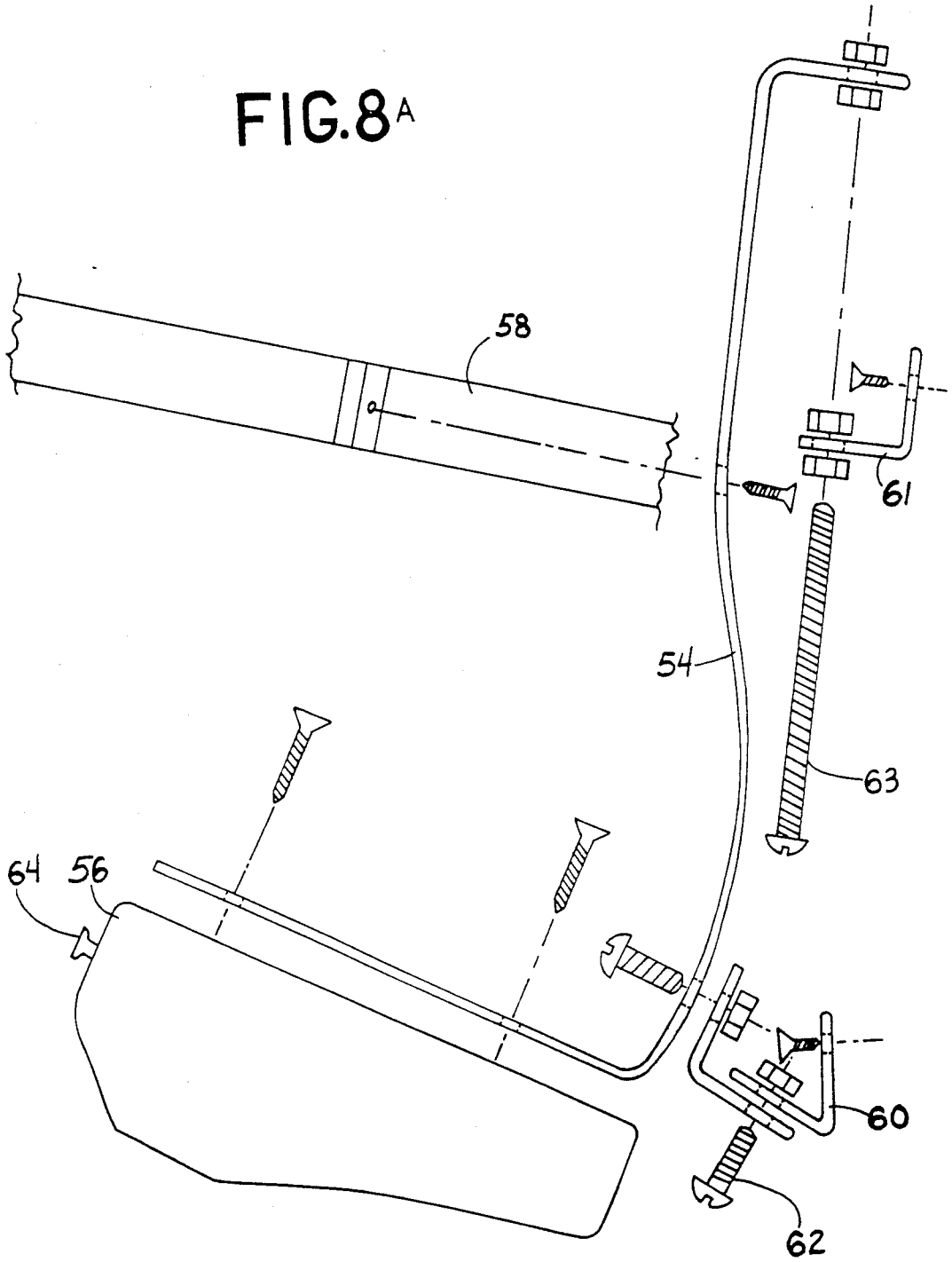
FIGS. 8A and 8B show an exploded view of the support mechanism and 8C shows the swing adjustment capabilities of the support arm. 8D shows the support foot collapsed to its carrying position.
Figure 8B:
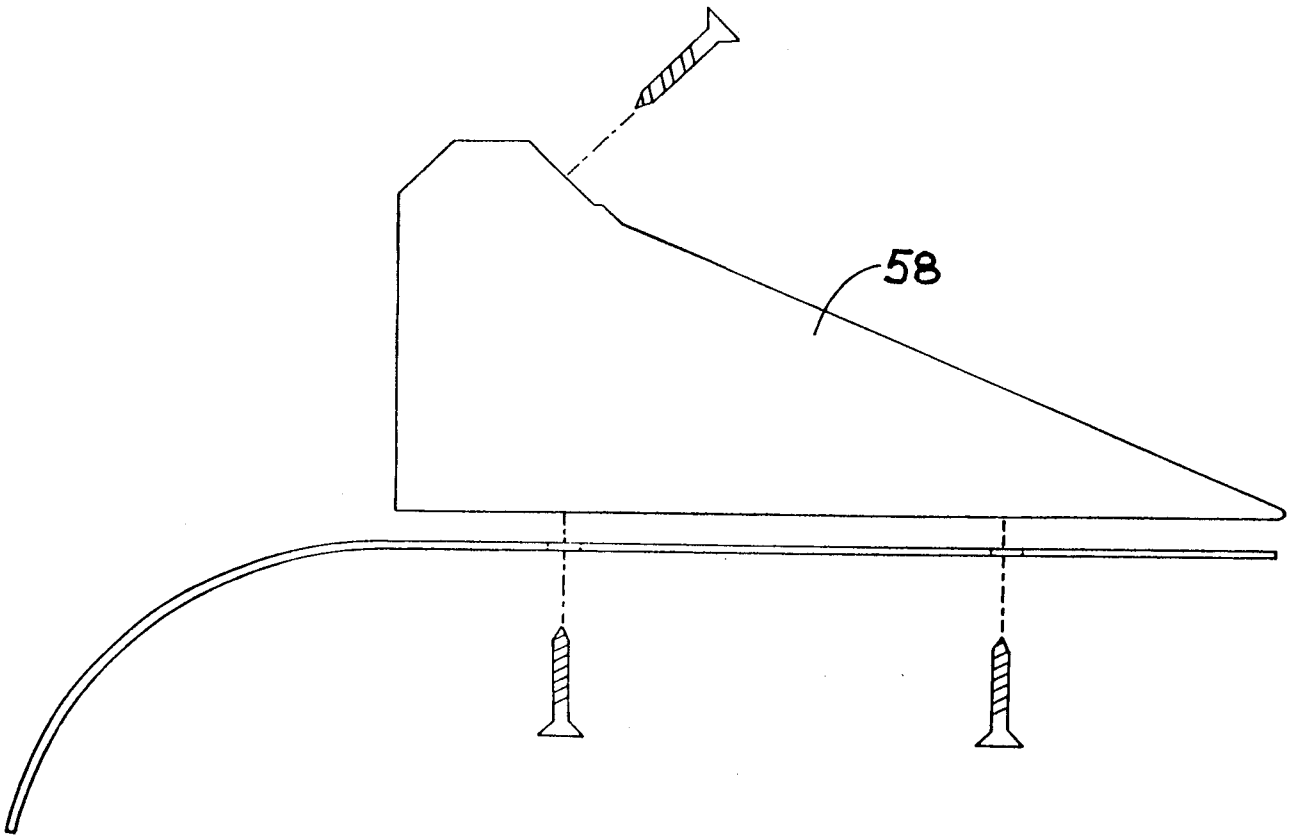
Figure 8C:
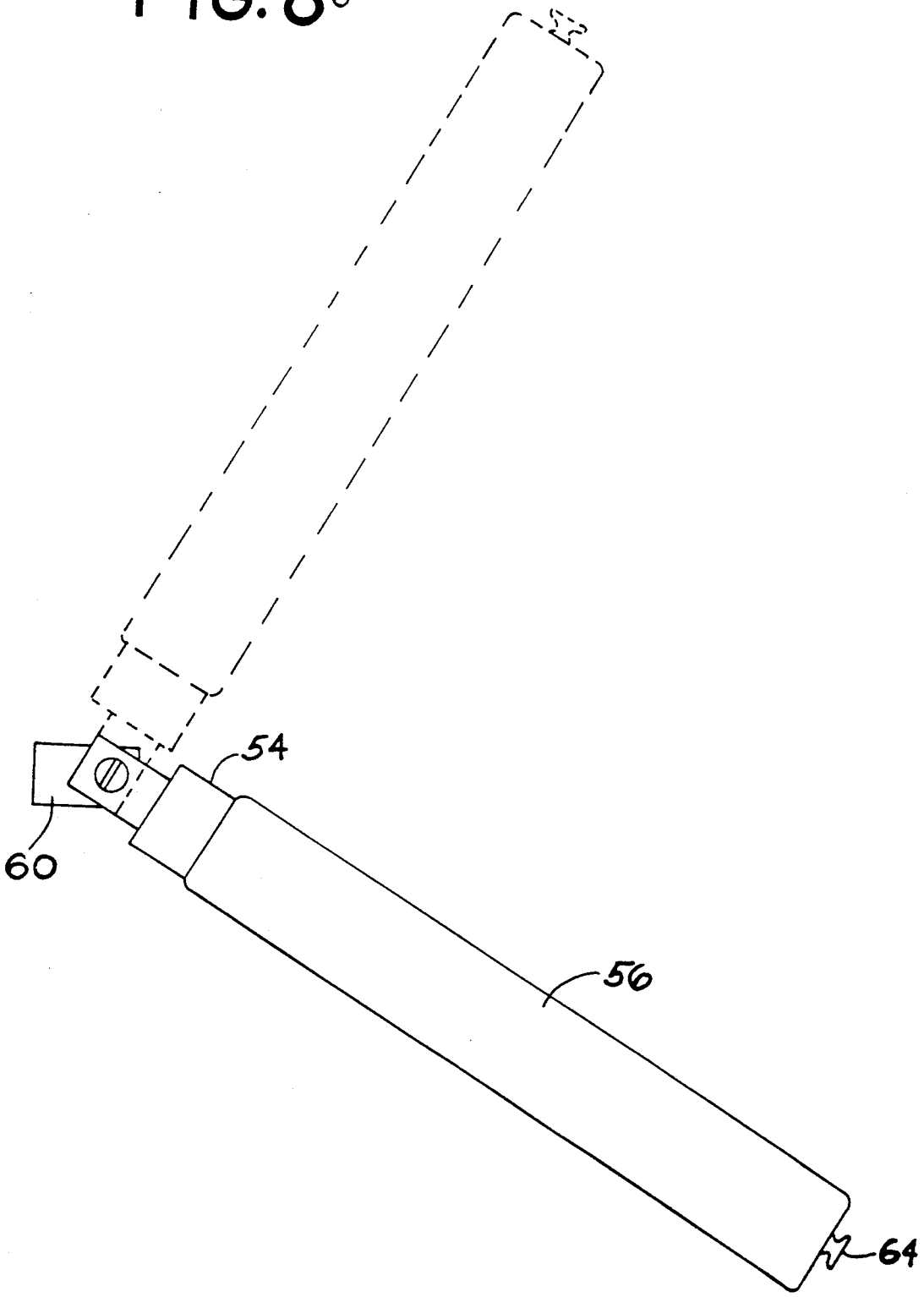
Figure 8D:
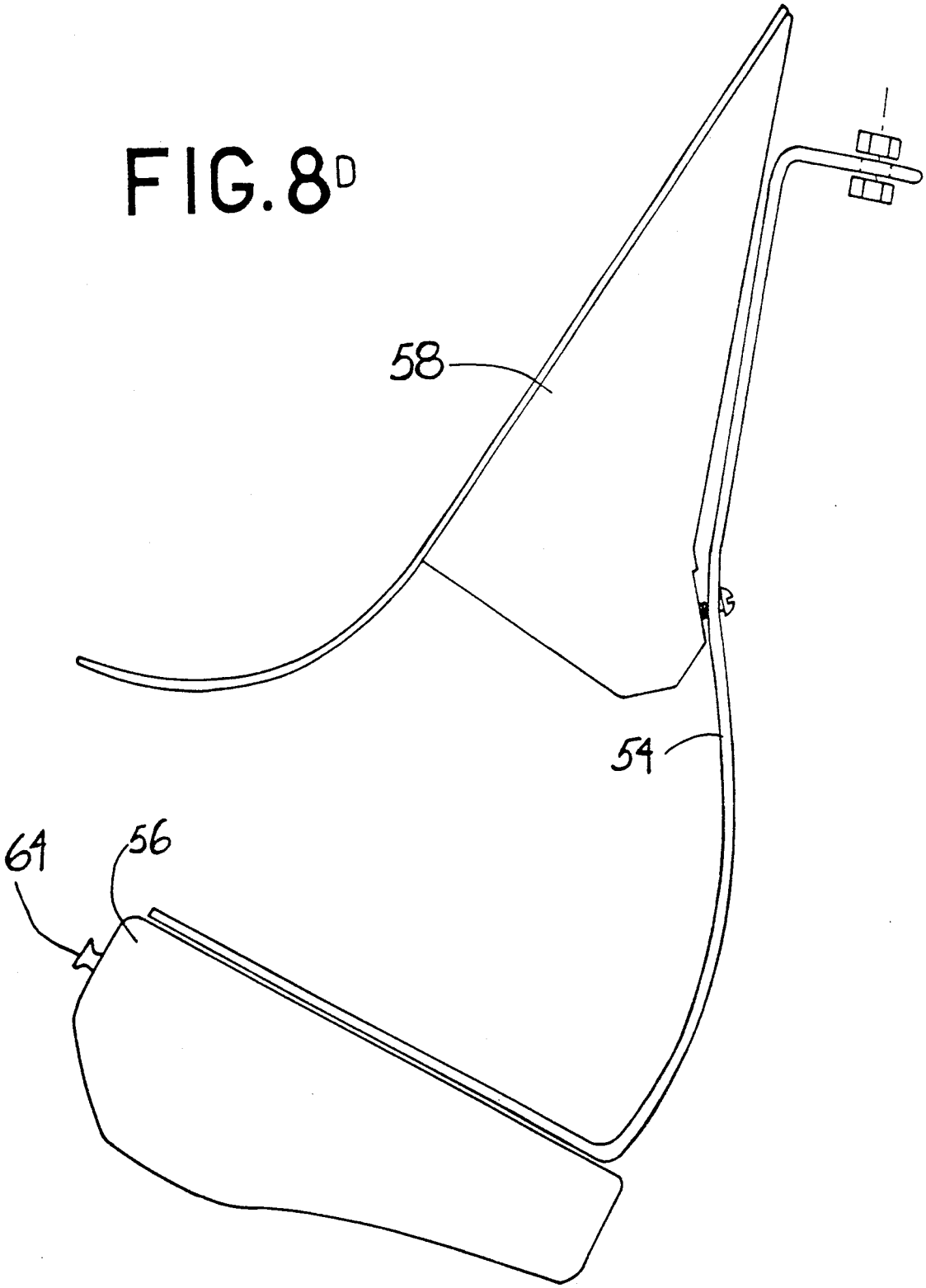

The support foot (58) in the preferred embodiment is designed to rotate upwards to lie flat against the curved metal bracket (54) when not in use to facilitate carrying the instrument (see FIG. 8D).

OPERATION—FIGS. 1 TO 8

The manner of playing the Electric Guitar/Violin is as follows. After tuning the instrument by means of tightening or loosening the allen head screws (46) in the tuning mechanism (18) with a hex key, the player then adjusts the orientation of the instrument. This is accomplished by passing a strap around the neck of the player and attaching it to the end pin (37) on the instrument and the end pin (64) on the support mechanism. The instrument can then be rotated on angle brackets (60) and (61) into the correct playing position and then locked there by means of retaining screws (62) and (63), (see FIG. 8B). Correct playing position allows all strings to be played with a bow while allowing the bow to remain clear of the player's body. The player can then draw the bow across the strings in the same manner as a violinist or violist, while fingering the instrument in the same manner as a guitarist. This allows the guitarist to produce sounds similar to those produced by an electric violinist or electric violist, without learning a complete new set of fingerings. The bowed sound is picked up best by the transducer (26 or 29) mounted at the bridge (15 or 16), (see FIG. 5).

The instrument is stabilized by means of the support mechanism (20). The support foot (58) rests on the player's shoulder, the chin block (56) is held down by the player's chin and a strap passes around the player's neck. The neck/body member (10) is fully supported and stabilized without either of the player's hands touching it.

A unique sound similar to that of an electric guitar is produced by means of the arched double coil pick-up (14) when the player plucks the strings with a finger or a plectrum.

SUMMARY, RAMIFICATIONS, AND SCOPE

Accordingly, the reader will see that the electric guitar/violin of this invention allows all six strings to be played discretely with a violin bow, provides unique support structure so as to allow the full scale of a standard electric guitar to be practical, and can be played by guitarists without necessitating the learning of any new of special fingerings. Furthermore, the instrument of this invention provides further advantages in that 1. The special support mechanism, along with the instrument's compact size, allows it to be played with a bow passing over the shoulder (clavicle) in the manner of a violin or viola.

2. The special support mechanism, combined with the resulting placement of the bridge relative to the player's body, allows an instrument played in the above manner to achieve a scale length impossible with ordinary violin or viola construction.

3. The specially arched double coil pick-up allows a plucked sound similar to an electric guitar.

4. The design of the instrument can include the enhanced accuracy of a fretted fingerboard, like a guitar, or the greater flexibility of a fretless fingerboard like a violin.

5. Having at least six strings, this instrument has a greater range than either the cello, the viola, or the violin alone.

6. The arched surface of the fingerboards allows this instrument to be played with a violin bow and makes a fingerboard with a 40 fret length musically practical.

Although the description above contains many specificities, this should not be construed as limiting the scope of the invention but as merely providing illustrations of preferred embodiments of this invention. For example, the range of the instrument may be extended with no structural alterations by tuning the 6th and 5th strings to C and G like a cello. This will give the instrument of this invention a range which exceeds the practical ranges of the violin, viola, and cello combined. Also, the body shape and composition may be varied, the support mechanism can be altered, the instrument may use a different number of strings, and the instrument may be adapted to trigger synthesizers by means of a special pick-up and midi conversion device.

Thus, the scope of this invention should be determined by the appended claims and their legal equivalents, rather than by the examples given.

I claim:

1. A stringed musical instrument comprising:

a) an elongated rigid body having a tail end and a tapered neck end;

b) a symmetrically arched fingerboard affixed to the top surface of the body;

c) a symmetrically arched bridge and nut affixed to the top surface of the body providing a means for supporting strings above said fingerboard and allowing said strings to be played individually with a bow;

d) a means for adjusting string tension affixed to one end of the body;

e) a plurality of strings ranging from bass to treble anchored at one end and extending over the arched nut, fingerboard and bridge and being affixed to the means for adjusting string tension;

f) a means for converting acoustic vibrations to electronic impulses mounted in proximity to a source of string vibration; and g) an adjustable support means comprising a balance point substantially in contact with the player's chest or shoulder area and a stabilizing point substantially in contact with said player's chin or neck area with said support means disposed in relation to said bridge so as to locate said bridge substantially in front of and below said player's chin and approximately in the center of said player's upper chest when said instrument is played with a bow passing over said player's shoulder or clavicle whereby scale lengths up to and including that of the standard guitar are made practical.

2. The musical instrument of claim 1 wherein a plurality of arched frets are affixed to said fingerboard.

3. The musical instrument of claim 2 wherein the number of said frets is forty (40) or more and all frets are accessible.

4. The musical instrument of claim 1, 2, or 3 wherein said means for converting acoustical vibrations comprises a transducer in contact with said bridge.

5. The musical instrument of claim 1, 2, 3 or 4 wherein said means for converting acoustically vibrations further comprises an electromagnetic pick-up affixed to a means for providing an arched magnetic field, mounted so that said strings pass through said arched magnetic field.

6. The musical instrument of claim 5 wherein the means for providing said arched magnetic field is comprised of magnet wire wrapped around a flexible member which is affixed to a symmetrically arched ferrous core member in contact with a permanent magnet so that said flexible member surrounds said ferrous core member and conforms to the symmetrical arch of said ferrous core member.

7. The musical instrument of claim 1, 2, 3, 4 or 5 wherein said means for supporting said body comprises a chin block affixed to an adjustable curved metal bracket, and a support foot adjustably affixed to said curved metal bracket so as to provide a balance point while bowing.

8. The musical instrument of claim 7 wherein said support foot is collapsible to lie parallel to said curved metal bracket and to facilitate carrying said musical instrument.

9. The musical instrument of claim 1, 2, 3, 4, 5, 7, or 8 wherein said support means further comprises a means for affixing a neck strap.

10. The musical instrument of claim 1, 2, 3, 4, 5, 7, 8 or 9 wherein the number of said strings is six.

11. The musical instrument of claim 1 wherein said means for adjusting string tension is attached to said tail end of elongated rigid body and comprises a plurality of screws each extending through a screw hole in an upper bracket and a lower bracket, each screw threaded through a string retainer having a hole for inserting and affixing each string.

12. The musical instrument of claim 1, 2, 3, 4, 5, 7, 8, 9, 10, or 11 wherein said musical instrument is tuned and fingered in the same manner as a standard guitar.

13. The musical instrument of claim 1, 2, 3, 4, 5, 7, 8, 9, 10, or 11 wherein said instrument is tuned to C-G-D-G-B-E from lowest to highest strings respectively such that the range of said instrument is extended beyond the practical ranges of the violin, viola and cello combined.

14. The musical instrument of claim 1 wherein the string anchoring means comprises a string lock mechanism affixed to the neck end of the body.

15. The musical instrument of claim 1 wherein the scale is equal to the standard guitar scale.

16. The musical instrument of claim 1 wherein said symetrically arched bridge comprises a vibrating top layer in contact with said strings, a sound absorbing layer, and an adjustable pedestal lever.

17. The musical instrument of claim 16 wherein said means for converting acoustical vibrations to electronic impulses is mounted between said vibrating top layer and said sound absorbing layer.

* * * * *